US005830087A

United States Patent [19]

Sullivan et al.

[11] Patent Number: 5,830,087

[45] Date of Patent: Nov. 3, 1998

[54] MULTI-LAYER GOLF BALL

[75] Inventors: Michael J. Sullivan, Chicopee; Dennis Nesbitt, Westfield; Mark Binette, Ludlow, all of Mass.

[73] Assignee: Lisco, Inc., Tampa, Fla.

[21] Appl. No.: 495,062

[22] Filed: Jun. 26, 1995

[51] Int. Cl.[6] ..... A63B 37/12

[52] U.S. Cl. ..... 473/385; 473/373

[58] Field of Search ..... 273/228; 473/372, 473/373, 374, 378, 385

[56] References Cited

U.S. PATENT DOCUMENTS

| | | | |
|---|---|---|---|
| 2,741,480 | 4/1956 | Smith | 273/227 |
| 2,973,800 | 3/1961 | Muccino | 154/17 |
| 3,053,539 | 9/1962 | Piechowski | 273/230 |
| 3,313,545 | 4/1967 | Bartsch | 273/218 |
| 3,502,338 | 3/1970 | Cox | 273/218 |
| 3,534,965 | 10/1970 | Harrison et al. | 273/218 |
| 3,572,721 | 3/1971 | Harrison et al. | 372/218 |
| 3,883,145 | 5/1975 | Cox et al. | 273/218 |
| 3,989,568 | 11/1976 | Isaac | 156/182 |
| 4,076,255 | 2/1978 | Moore et al. | 273/226 |
| 4,123,061 | 10/1978 | Dusbiber | 273/220 |
| 4,272,079 | 6/1981 | Nakade et al. | 273/225 |
| 4,274,637 | 6/1981 | Molitor | 273/235 R |
| 4,431,193 | 2/1984 | Nesbitt | 273/235 R |
| 4,650,193 | 3/1987 | Molitor et al. | 273/228 |
| 4,714,253 | 12/1987 | Nakahara et al. | 273/228 |
| 4,852,884 | 8/1989 | Sullivan | 273/230 |
| 4,858,923 | 8/1989 | Gobush et al. | 273/62 |
| 4,858,924 | 8/1989 | Saito et al. | 273/62 |
| 4,911,451 | 3/1990 | Sullivan et al. | 273/235 R |
| 4,919,434 | 4/1990 | Saito | 273/235 R |
| 4,979,746 | 12/1990 | Gentiluomo | 273/220 |
| 5,002,281 | 3/1991 | Nakahara et al. | 273/220 |
| 5,019,319 | 5/1991 | Nakamura et al. | 273/218 |
| 5,026,067 | 6/1991 | Gentiluomo | 273/220 |
| 5,048,838 | 9/1991 | Chikaraishi et al. | 273/228 |
| 5,068,151 | 11/1991 | Nakamura | 428/407 |
| 5,072,944 | 12/1991 | Nakahara et al. | 273/220 |
| 5,096,201 | 3/1992 | Egashira et al. | 273/218 |
| 5,104,126 | 4/1992 | Gentiluomo | 273/228 |
| 5,184,828 | 2/1993 | Kim et al. | 273/228 |
| 5,197,740 | 3/1993 | Pocklington et al. | 273/235 R |
| 5,253,871 | 10/1993 | Viollaz | 273/228 |
| 5,273,286 | 12/1993 | Sun | 273/228 |
| 5,273,287 | 12/1993 | Molitor et al. | 273/232 |
| 5,304,608 | 4/1994 | Yabuki et al. | 525/274 |
| 5,306,760 | 4/1994 | Sullivan | 524/400 |
| 5,368,304 | 11/1994 | Sullivan et al. | 273/220 |
| 5,439,227 | 8/1995 | Egashira et al. | 273/228 |
| 5,482,285 | 1/1996 | Yabuki et al. | 273/228 |

FOREIGN PATENT DOCUMENTS

| | | |
|---|---|---|
| 0 633 043 A1 | 1/1995 | European Pat. Off. . |
| 0 637 459 A1 | 2/1995 | European Pat. Off. . |
| 494031 | 10/1938 | United Kingdom . |
| 2 245 580 | 1/1992 | United Kingdom . |

OTHER PUBLICATIONS

English Abstract for JP 61–42228, publ. May 24, 1994, which is a counterpart of U.S. Patent No. 5,439,227.

*Primary Examiner*—George J. Marlo

[57] ABSTRACT

Disclosed herein is a multi-layer golf ball having a central core, an inner cover layer containing a non-ionomeric polyolefin material, preferably a plastomer, and an outer cover layer comprising a thermoplastic material. The combined thickness of the inner and outer cover layer preferably is at least about 0.10 inches. The golf ball has a coefficient of restitution of at least about 0.780. When the inner cover layer contains a non-ionomeric material such as a metallocene-catalyzed polyolefin and the outer cover layer contains ionomer, the golf ball of the invention can be configured to have playability properties comparable to those of golf balls which contain substantially higher quantities of ionomer. A method for forming the golf ball described above also is disclosed.

28 Claims, 1 Drawing Sheet

MULTI-LAYER GOLF BALL

FIELD OF THE INVENTION

The present invention generally relates to golf balls, and more particularly to a golf ball having a multi-layer cover.

BACKGROUND OF THE INVENTION

Golf balls traditionally have been categorized in three different groups, namely as one-piece, two-piece and three-piece balls. Conventional two-piece golf balls include a solid resilient core having a cover of a different type of material molded thereon. Three-piece golf balls traditionally have included a liquid or solid center, elastomeric winding around the center, and a molded cover. Solid cores of both two and three-piece balls often are made of polybutadiene and the molded covers generally are made of natural balata, synthetic balata, or ionomeric resins.

Ionomeric resins are polymers containing interchain ionic bonding.

As a result of their toughness, durability and flight characteristics, various ionomeric resins sold by E.I. DuPont de Nemours & Company under the trademark "Surlyn®" and by the Exxon Corporation (see U.S. Pat. No. 4,911,451) under the trademarks "Escor®" and the trade name "lotek", have become the materials of choice for the construction of golf ball covers over the traditional "balata" (transpolyisoprene, natural or synthetic) rubbers. The softer balata covers, although exhibiting enhanced playability properties, lack the durability (cut and abrasion resistance, fatigue endurance, etc.) properties required for repetitive play.

Ionomeric resins are generally ionic copolymers of an olefin, such as ethylene, and a metal salt of an unsaturated carboxylic acid, such as acrylic acid, methacrylic acid or maleic acid. Metal ions, such as sodium or zinc, are used to neutralize some portion of the acidic group in the copolymer resulting in a thermoplastic elastomer exhibiting enhanced properties, i.e., durability, etc., for golf ball cover construction over balata.

While there are currently more than fifty (50) commercial grades of ionomers available both from Exxon and DuPont, with a wide range of properties which vary according to the type and amount of metal cations, molecular weight, composition of the base resin (i.e., relative content of ethylene and methacrylic and/or acrylic acid groups) and additive ingredients such as reinforcement agents, etc., a great deal of research continues in order to develop golf ball covers exhibiting the desired combination of the properties of carrying distance, durability, and spin.

Various non-ionomeric thermoplastic materials have been used for golf ball covers, but have been found inferior to ionomers in achieving good cut resistance, fatigue resistance and travel distance. It would be useful to obtain a golf ball having a cover which incorporates non-ionomeric materials while achieving the favorable playability and durability characteristics of a ball having a cover which primarily contains ionomers.

U.S. Pat. Nos. 4,431,193 and 4,919,434 disclose multi-layer golf balls. U.S. Pat. No. 4,431,193 discloses a multi-layer ball with a hard ionomeric inner cover layer and a soft outer cover layer. U.S. Pat. No. 4,919,434 disclose a golf ball with a 0.4–2.2 mm thick cover made from two thermoplastic cover layers.

Golf balls are typically described in terms of their size, weight, composition, dimple pattern, compression, hardness, durability, spin rate and coefficient of restitution (COR). One way to measure the COR is to propel a ball at a given speed against a hard massive surface, and to measure its incoming and outgoing velocity. The COR is the ratio of the outgoing velocity to the incoming velocity and is expressed as a decimal between zero and one.

There is no United States Golf Association limit on the COR of a golf ball but the initial velocity of the golf ball must not exceed 250±5 ft/second. As a result, the industry goal for initial velocity is 255 ft/ second, and the industry strives to maximize the COR without violating this limit.

SUMMARY OF THE INVENTION

An object of the invention is to provide a golf ball having a good coefficient of restitution while reducing the overall quantity of ionomer in the cover.

Another object of the invention is to provide a golf ball having a good carrying distance while maintaining a relatively soft compression.

Another object of the invention is to provide an oversized golf ball having a favorable combination of a soft compression and a good COR.

Yet another object of the invention is to provide a multi-layer solid golf ball having durability and playability properties which are comparable to those of a golf ball having a single ionomeric cover layer.

A further object of the invention is to provide a method of making a golf ball having the features described above.

Other objects will be in part obvious and in part pointed out more in detail hereinafter.

The invention in a preferred form is a golf ball comprising a core, an inner cover layer containing at least 50 wt % of a non-ionomeric polyolefin material and an outer cover layer comprising a thermoplastic material. The combined thickness of the inner and outer cover layers is at least about 0.10 inches, and preferably is at least 0.12 inches. The golf ball has a coefficient of restitution of at least about 0.780.

The inner cover layer preferably has a flexural modulus of about 1,000–50,000 p.s.i. and a polymer density of about 0.870–0.918 g/cc. In a particularly preferred form of the invention, the inner cover layer contains at least 75 wt %, and most preferably at least 90 wt % of a non-ionomeric polyolefin material. The inner cover layer preferably has a Shore D hardness of less than 65 (ASTM D-2240) and a thickness of at least 0.040 inches. The outer cover layer preferably has a greater hardness than the inner cover layer and a Shore D hardness of at least 60 (ASTM D-2240). The outer cover layer preferably has a thickness of at least about 0.030 inches.

Another preferred form of the invention is a golf ball having a core, an inner cover layer comprising a metallocene-catalyzed polyolefin, and an outer cover layer comprising a thermoplastic material. The inner cover layer preferably has a Shore D hardness of less than 65 (ASTM D-2240).

A further preferred form of the invention is a method of making a golf ball with a coefficient of restitution of at least about 0.780 which has a core and has an outer cover layer comprising a thermoplastic material. The method comprises positioning an inner cover layer which includes a metallocene-catalyzed polyolefin between the core and outer cover layer.

Yet another preferred form of the invention is a method of making a golf ball with a coefficient of restitution of at least about 0.780 which has a core and has an outer cover layer comprising a thermoplastic material. The method comprises positioning an inner cover layer between the core and the outer cover layer, the inner cover layer containing at least 50 wt % of a non-ionomeric polyolefin and having a thickness of at least about 0.040.

The invention accordingly comprises the several steps and the relation of one or more of such steps with respect to each of the others and the article possessing the features, properties, and the relation of elements exemplified in the following detailed disclosure.

DETAILED DESCRIPTION OF THE INVENTION

Figure 1:
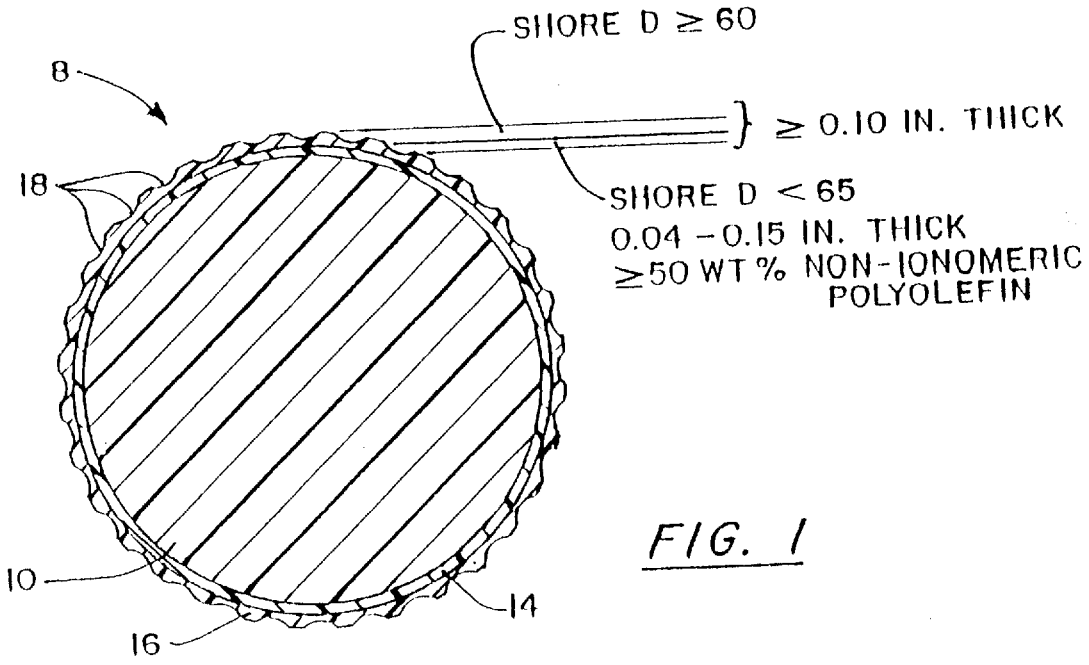
FIG. 1 shows a cross-sectional view of a golf ball according to a preferred embodiment of the invention.
Figure 2:
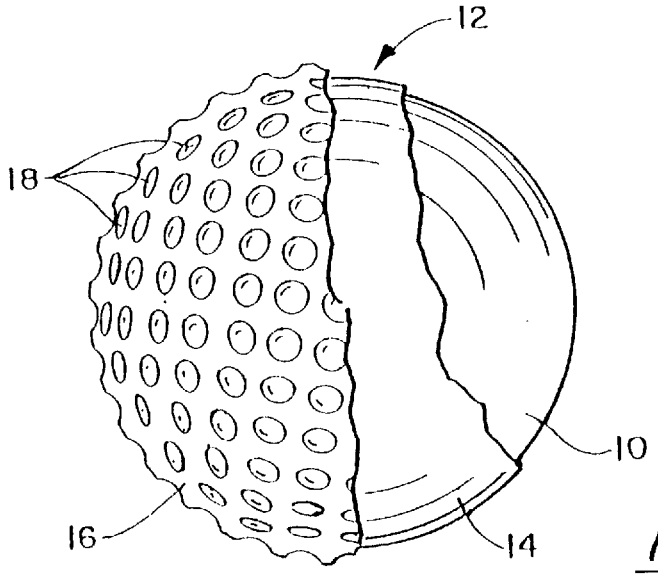
FIG. 2 shows a side elevational view of the golf ball shown in FIG. 1 with the cover layers partially broken away.

The golf ball according to the invention has a central core and a thick cover which includes at least two separate layers. The golf ball is constructed to have a favorable combination of soft compression and a good COR.

Referring now to the Figures, a golf ball according to the invention is shown and is designated as 8. The golf ball includes a central core 10 and a cover 12. The cover 12 includes an inner cover layer 14 and an outer cover layer 16. Dimples 18 are formed in the outer surface of the outer cover layer 16. The ball preferably has a diameter of at least 1.68 inches, and more preferably at least 1.70 inches.

The core 10 of the golf ball typically is made of a crosslinked unsaturated elastomer and preferably comprises a thermoset rubber such as polybutadiene, but also can be made of other core materials which provide sufficient COR. The diameter of the core 10 is determined based upon the desired overall ball diameter minus the combined thicknesses of the inner and outer cover layers. The COR of the core 10 is appropriate to impart to the finished golf ball a COR of at least 0.780, and preferably at least 0.790. The core 10 typically has a diameter of about 1.0–1.6 inches and preferably 1.4–1.6 inches, a PGA compression of 80–100, and a COR in the range of 0.770–0.830. The Shore D hardness of the outer surface of the core typically is about 25–60 (ASTM D-2240).

Conventional solid cores are typically compression molded from a slug of uncured or lightly cured elastomer composition comprising a high cis content polybutadiene and a metal salt of an $\alpha,\beta$, ethylenically unsaturated carboxylic acid such as zinc mono or diacrylate or methacrylate. To achieve higher coefficients of restitution in the core, the manufacturer may include fillers such as small amounts of a metal oxide such as zinc oxide. In addition, larger amounts of metal oxide than those that are needed to achieve the desired coefficient are often included in conventional cores in order to increase the core weight so that the finished ball more closely approaches the U.S.G.A. upper weight limit of 1.620 ounces. Other materials may be used in the core composition including compatible rubbers or ionomers, and low molecular weight fatty acids such as stearic acid. Free radical initiators such as peroxides are admixed with the core composition so that on the application of heat and pressure, a complex curing cross-linking reaction takes place.

The inner cover layer 14 surrounds the core 10 and contains at least 50 wt %, more preferably at least 75 wt %, and most preferably at least 90 wt % of a non-ionomeric polyolefin. A non-ionomeric polyolefin according to the invention is a polyolefin which is not a copolymer of an olefin , such as ethylene or another olefin having from 2 to 8 carbon atoms, and a metal salt of an unsaturated monocarboxylic acid, such as acrylic acid, methacrylic acid or another unsaturated monocarboxylic acid having from 3 to 8 carbon atoms. It is not necessary that the inner cover layer 14 contribute to the COR of the ball. In fact, the covered core may have a COR that is somewhat lower than the COR of the central core. The degree to which the inner cover layer 14 can slightly reduce COR of the core 10 will depend upon the thickness of the outer cover layer 16 and the degree to which the outer cover layer 16 contributes to COR. To enable a broad range of outer cover layer materials to be used, it is preferred that the inner cover layer 14 result in no more than a 0.5–10% reduction in the COR for the core when covered with the inner cover layer, as compared to the COR of the core 10 alone.

In a particularly preferred form of the invention, the inner cover layer 14 is substantially softer and more compressible than the outer cover layer 16, thereby imparting to the golf ball a favorable soft feel without substantially reducing the overall COR of the ball. The inner cover layer 14 preferably has a Shore D hardness (ASTM D-2240) in the range of 1–65, more preferably 15–40 (ASTM D-2240), and most preferably about 20–30(ASTM D-2240). On the other hand, hard inner cover layers 14 can be used as long as favorable playability and durability are maintained. The inner cover layer 14 has a thickness of 0.040–0.150 inches, more preferably 0.050–0.125 inches, and most preferably 0.055–0.10 inches.

In the preferred embodiment, the inner cover layer 14 is softer than the outer surface of the core 10. While the outer surface of the core can have a Shore D hardness which is similar to or less than that of the material of inner cover layer 14, it is preferred that the Shore D hardness of the inner cover layer 14 not exceed the Shore D hardness of the outer surface of the core 10 by more than about 5.

Examples of non-ionomeric polyolefin materials which are suitable for use in forming the inner cover layer 14 include, but are not limited to, low density polyethylene, linear low density polyethylene, high density polyethylene, polypropylene, rubber-toughened olefin polymers, acid copolymers which do not become part of an ionomeric copolymer when used in the inner cover layer, plastomers, flexomers, and thermoplastic elastomers such as SBS (styrene/butylene/styrene) or SEBS (styrene/ethylene-butylene/styrene) block copolymers, including Kraton® (Shell), dynamically vulcanized elastomers such as Santoprene® (Monsanto), ethylene vinyl acetates such as Elvax® (DuPont), and ethylene methyl acrylates such as Optema® (Exxon), etc. Mixtures of these materials can be used. It is desirable that the polyolefin be a tough, low density material. The non-ionomeric polyolefins can be mixed with ionomers. The inner cover layer 14 optionally may include a metal stearate, such as zinc stearate, or another mineral filler or metal fatty acid salt. In a preferred form of the invention, the inner cover layer contains a plastomer, preferably at least 50 wt % plastomer.

Particularly preferred types of inner cover material are known as EXACT™ plastomers (Exxon Chemical Co., Houston, Tex.). EXACT™ plastomers are metallocene-catalyzed polyolefins. This family of plastomers has a density of 0.87–0.915 g/cc, melting points in the range of 140°–220° F., Shore D hardness in the range of 20–50 (ASTM D-2240), flexural modulus in the range of 2–15 k.p.s.i., tensile strength of 1600–4000 p.s.i., excellent thermal stability, and very good elastic recovery. One of these materials, known as EXACT™ 4049, is a butene copolymer with a comonomer content of less than 28% and a polymer density of 0.873 g/cc. The properties of EXACT™ 4049 are shown on Table 1 below:

| | Typical Values[1] | ASTM Method |
|---|---|---|
| Polymer Properties | | |
| Melt Index | 4.5 dg/min | D-1238 (E) |
| Density | 0.873 g/cm$^3$ | D-792 |
| Elastomer Properties[2] | | |
| Hardness | 72 Shore A<br>20 Shore D | D-2240 |
| Ultimate Tensile[3], Die D | 900 p.s.i. (6.4 MPa) | D-412 |
| Tensile Modulus | | D-412 |
| @ 100% elongation | 280 p.s.i. (2 MPa) | |
| @ 300% elongation | 350 p.s.i. (2.4 MPa) | |
| Ultimate Elongation | 2000% | D-412 |
| Brittleness Temperature | ←112° F. (←80° C.) | D-746 |
| Vicat Softening Point, 200 g | 130° F. (55° C.) | D-1525 |
| Mooney Viscosity (1 + 4 @ 125° C.) | 6.5 Torque Units | D-1646 |

[1]Values are typical and are not to be interpreted as specifications.
[2]Compression molded specimens.
[3]Tensile properties determined using a type D die & a crosshead speed of 20 in/min
This material has been found to be particularly useful in forming the inner cover layer 14. Similar materials sold by Dow Chemical Co. as Insite ® technology under the Affinity ® and Engage ® trademarks also can be used.

The outer cover layer 16 surrounds the inner cover layer 14 and is formed from a material that has properties sufficient to contribute about 0.001–0.050 points, more preferably 0.010–0.040 points, and most preferably at least 0.015 points to the COR of the ball. The outer cover layer preferably comprises an ionomer. Alternatively or additionally, other thermoplastic materials which can contribute to the COR of the ball at necessary amounts can be used. The ionomer can be of a single type or can be a blend of two or more types of ionomers. One or more hardening or softening modifiers can be blended with the ionomer.

The compression of the outer cover layer is appropriate to result in an overall PGA ball compression of about 30–110, more preferably 50–100, and most preferably 60–90.

The outer cover layer preferably has a thickness of 0.030–0.150 inches, more preferably 0.050–0.10 inches, and most preferably 0.06–0.09 inches. The combined thickness of the inner and outer cover layers typically is in the range of 0.10–0.25 inches, more preferably 0.10–0.20 inches, and most preferably 0.10–0.15 inches. The ratio of the ball diameter to the overall cover thickness preferably is no more than about 18:1, more preferably no more than about 17:1, and most preferably no more than about 15:1. In a preferred form of the invention, the multi-layer golf ball has playability properties comparable to those of a ball with a single-layer ionomeric cover, but the multi-layer ball contains only 5–90 wt % as much ionomer, and more preferably only 40–60 wt % as much ionomer as a ball with a single cover layer.

The outer cover layer can be coated with a top coat of a conventional type and thickness. Optionally, a conventional primer coat can be used between the outer cover layer and the top coat.

The golf ball of the invention generally has a diameter of at least 1.68 inches, and preferably is an oversized ball with a diameter of at least 1.70 inches, or more preferably at least 1.72 inches. In addition to allowing the use of larger diameter dimples, the larger diameter ball provides a moment which is greater than the conventional ball. This greater moment reveals itself by having a lower backspin rate after impact than the conventional ball. Such a lower backspin rate contributes to straighter shots, greater efficiency in flight, and a lesser degree of energy loss on impact with the ground. On impact with the ground, all balls reverse their spin from backspin to over-spin. With lower backspin on impact, less energy is absorbed in this reversal than with conventional balls. This is especially true with woods because of the lower trajectory resulting from a lower backspin. As a result, the ball strikes the ground at a more acute angle, adding increased roll and distance.

The golf ball of the invention preferably, but not necessarily, has a spin in the range of 9,000 revolutions per minute (rpm) or less, and more preferably 8,000 rpm or less. To provide for appropriate values of durability and spin, the Shore D hardness of the outer cover layer should be at least about 60 (ASTM D-2240). The PGA compression of the ball preferably is no more than about 90, and more preferably no more than about 80.

When the golf ball of the invention has more than two cover layers, the inner cover layer can be formed from two or more layers which, taken together, meet the requirements of softness, thickness and compression of the layer or layers which are defined herein as the inner cover layer. Similarly, the outer cover layer can be formed from two or more layers which, taken together, meet the requirements of hardness, thickness and compression of the layer or layers which are defined herein as the outer cover layer. Furthermore, one or more additional, very thin ionomeric or non-ionomeric layers can be added on either side of the inner cover layer as long as the objectives of the invention are achieved.

COMPARATIVE EXAMPLE 1

About 12 golf ball cores having a diameter of 1.545 inches, a PGA compression of 64 and a COR of 0.765 were obtained. The cores contained a blend of polybutadiene, zinc diacrylate, zinc dimethacrylate, and conventional additives.

A single cover layer having a thickness of 0.090 inches was injection molded over the cores. The cover material contained a blend of ionomers designated as ionomer 1 and had a Shore D hardness of 68 (ASTM D-2240). The covered balls were primed and top coated using conventional materials. Properties of the balls are shown on Table 1.

The balls had a PGA compression of 88.5, a COR of 0.807 and a spin rate of about 7368 revolutions per minute (rpm) when struck with a 9-iron under conditions of launch angle, ball speed and tee position which produced a spin rate of about 7100 rpm for a two-piece hard covered ball (1994 Top-Flite XL) and a spin rate of about 9700 rpm for a thread wound balata covered ball (1994 Titleist Tour 100) using the same club.

EXAMPLE 1

About 12 golf ball cores made of the same material as those of Comparative Example 1 and having a diameter of 1.43 inches were obtained. The cores had a COR of 0.763. The cores were coated with a polyolefin material in a thickness of 0.058 inches. The polyolefin material was a butene comonomer with a melt index of 4.5 dg/min and is available under the unregistered trademark EXACT™ 4049 (Exxon Chemical Company, Houston, Tex.).

An outer cover layer formed from the same blend of ionomers as was used for the covers of the balls of Comparative Example 1 was injection molded over the inner cover layers in a thickness of 0.090 inches. The outer cover layer had a Shore D hardness of 68 (ASTM D2240).

The resulting golf balls were primed and top coated using the same materials and thickness as were used in Comparative Example 1. The resulting balls had a coefficient of restitution of 0.796, and a PGA compression 79. The properties of the cores, cover layers and overall golf balls are shown on Table 1.

EXAMPLES 2–5

The procedure of Example 1 was repeated using different combinations of inner cover layer thickness and core size and composition. The same types of inner and outer cover layer materials were used in Examples 2–5 as were used in Example 1. The results are shown on Table 1.

As shown by Examples 1–5, golf balls having a good coefficient of restitution and soft compression can be obtained even when the inner cover layer is not an ionomer or balata. Surprisingly, the relative thicknesses of the inner cover layer and outer cover layer had little impact on COR. The balls of Example 5 exhibited a high COR while having a thick inner cover layer and a soft compression. The balls of Example 3 have a relatively high COR in combination with a soft inner cover layer and a low spin rate.

TABLE 1

| Example # | Core Material | Core Size (inches) | Core COMP (PGA) | Core COR (×1000) | Inner Cover Layer Material | Inner Cover Layer Thickness (inches) | Inner Cover Layer COMP (PGA) | Inner Cover Layer COR (×1000) | Inner Cover Layer Hardness (Shore D) | Outer Cover Layer Thickness (inches) | Ball COMP (PGA) | Ball COR (×1000) | Ball Weight (g) | Ball Spin (RPM) |
|---|---|---|---|---|---|---|---|---|---|---|---|---|---|---|
| Comp. 1 | PBD BL1[1] | 1.545 | 64 | 765 | None | N/A | N/A | N/A | N/A | 0.090 | 89 | 807 | 45.3 | 7368 |
| 1 | PBD BL1 | 1.43 | —[2] | 763 | Polyolefin | 0.058 | 58 | 763 | 30 | 0.090 | 79 | 796 | 45.9 | — |
| 2 | PBD BL1 | 1.43 | — | 763 | Polyolefin | 0.070 | 55 | 761 | 30 | 0.075 | 78 | 794 | 43.8 | 7945 |
| 3 | PBD BL2[3] | 1.47 | 90 | 789 | Polyolefin | 0.050 | 82 | 787 | 30 | 0.0765 | 93 | 806 | 44.9 | 7736 |
| 4 | PBD BL2 | 1.43 | — | 788 | Polyolefin | 0.058 | 75 | 785 | 30 | 0.090 | 89 | 807 | 44 | 8039 |
| 5 | PBD BL2 | 1.43 | — | 788 | Polyolefin | 0.070 | 70 | 784 | 30 | 0.075 | 83 | 803 | 45.8 | — |

[1]Polybutadiene blend 1
[2]"—" indicates that no measurement was made due to small core size
[3]Polybutadiene blend 2

We claim:

1. A golf ball, comprising a core, an inner cover layer containing at least 50 wt % of a non-ionomeric polyolefin material, and an outer cover layer comprising a thermoplastic material and having a different composition than the inner cover layer, the golf ball having a coefficient of restitution of at least 0.780 and an overall cover thickness of at least 0.10 inches.

2. A golf ball according to claim 1, wherein the inner cover layer has a Shore D hardness of less than 65.

3. A golf ball according to claim 2, wherein the non-ionomeric polyolefin material includes at least one member selected from the group consisting of low density polyethylene, linear low density polyethylene, high density polyethylene, polypropylene, rubber-toughened olefin polymers, acid copolymers which do not become part of an ionomeric copolymer, plastomers, flexomers, styrene/butadiene/styrene block copolymers, styrene/ethylene-butylene/styrene block copolymers, dynamically vulcanized elastomers, ethylene vinyl acetates, and ethylene methyl acrylates.

4. A golf ball according to claim 1, wherein the outer cover layer is harder than the inner cover layer and has a Shore D hardness of at least about 60.

5. A golf ball according to claim 1, wherein the combined thickness of the inner cover layer and the outer cover layer is at least 0.12 inches.

6. A golf ball according to claim 1, wherein the inner cover layer has a thickness of at least 0.040 inches.

7. A golf ball according to claim 1, wherein the outer cover layer comprises an ionomer.

8. A golf ball according to claim 1, wherein the non-ionomeric polyolefin material of the inner cover layer includes at least 50 wt % plastomer.

9. A golf ball according to claim 8, wherein the non-ionomric polyolefin material of the inner cover layer comprises a metallocene-catalyzed polyolefin.

10. A golf ball according to claim 1, wherein the inner cover layer contains at least 75 wt. % of a non-ionomeric polyolefin material.

11. A golf ball according to claim 1, wherein the outer cover layer contributes 0.010–0.040 points to the coefficient of restitution of the ball.

12. A golf ball according to claim 1, wherein the non-ionomeric polyolefin material of the inner cover layer includes at least one metallocene catalyzed polyolefin having a density of 0.87–0.915 g/cc, a melting point in the range of 140°–220° F., a Shore D hardness in the range of 20–50 (ASTM D-2240), a flexural modulus in the range of 2–15 k.p.i., and a tensile strength of 1,600–4,000 p.s.i.

13. A golf ball according to claim 1, wherein the ball has a PGA compression of no more than 90.

14. A golf ball according to claim 1, wherein the non-ionomeric polyolefin material includes at least one member selected from the group consisting of low density polyethylene, linear low density polyethylene, high density polyethylene, polypropylene, rubber-toughened olefin polymers, acid copolymers which do not become part of an ionomeric copolymer, plastomers, flexomers, styrene/butadiene/styrene block copolymers, styrene/ethylene-butylene/styrene block copolymers, dynamically vulcanized elastomers, ethylene vinyl acetates, and ethylene methyl acrylates.

15. A golf ball comprising a core, an inner cover layer comprising a metallocene-catalyzed polyolefin, and an outer cover layer comprising a thermoplastic material and having a different composition than the inner cover layer.

16. A golf ball according to claim 15, wherein the inner cover layer contains at least 50 wt % of the metallocene-catalyzed polyolefin.

17. A golf ball according to claim 15, wherein the inner cover layer has a Shore D hardness of 20–65.

18. A golf ball according to claim 15, wherein the inner cover layer has a thickness of at least 0.040 inches.

19. A golf ball according to claim 15, wherein the outer cover layer comprises an ionomer.

20. A golf ball according to claim 15, wherein the inner cover layer comprises at least 75 wt % metallocene-catalyzed polyolefin.

21. A golf ball according to claim 15, wherein the inner cover layer has a flexural modulus of 1,000–50,000 p.s.i.

22. A golf ball according to claim 15, wherein the inner cover layer contains at least 75 wt. % of a non-ionomeric polyolefin material.

23. A golf ball according to claim 15, wherein the non-ionomeric polyolefin material of the inner cover layer includes at least one metallocene catalyzed polyolefin having a density of 0.87–0.915 g/cc, a melting point in the range of 140°–220° F., Shore D hardness in the range of 20–50 (ASTM D-2240), a flexural modulus in the range of 2–15 k.p.i., and a tensile strength of 1,600–4,000 p.s.i.

24. A method of making a golf ball with a coefficient of restitution of at least 0.780, the golf ball having a core and having an outer cover layer comprising a thermoplastic material, the method comprising positioning an inner cover layer which includes a metallocene-catalyzed polyolefin and which has a different composition than the outer cover layer between the core and the outer cover layer.

25. A method according to claim 24, wherein the inner cover layer contains at least 50 wt % metallocene-catalyzed polyolefin.

26. A method of making a golf ball having a core, an outer cover layer comprising a thermoplastic material, and a coefficient of restitution of at least 0.780, comprising positioning an inner cover layer between the core and the outer cover layer, the inner cover layer containing at least 50 wt % of a non-ionomeric polyolefin material, having a different composition than the outer cover layer and having a thickness of at least 0.030 inches, the sum of the thickness of the inner cover layer and outer cover layer being at least 0.10 inches.

27. A method according to claim 26, wherein the inner cover layer contains at least 75 wt % plastomer.

28. A method according to claim 26, wherein the inner cover layer is softer than the outer cover layer.

* * * * *